US007252776B2

(12) United States Patent
Chen et al.

(10) Patent No.: US 7,252,776 B2
(45) **Date of Patent: *Aug. 7, 2007**

(54) METHOD FOR FABRICATING A THERMAL BUBBLE INKJET PRINT HEAD WITH RAPID INK REFILL MECHANISM AND OFF-SHOOTER HEATER

(75) Inventors: Chung-Chu Chen, Taichung (TW); Chen-Kuei Chung, Tainan (TW); Chun-Jun Lin, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/315,567

(22) Filed: Dec. 22, 2005

(65) Prior Publication Data

US 2006/0158483 A1 Jul. 20, 2006

Related U.S. Application Data

(62) Division of application No. 10/057,026, filed on Jan. 24, 2002, now Pat. No. 7,011,392.

(51) Int. Cl.
*B41J 2/16* (2006.01)

(52) U.S. Cl. ..... 216/27; 29/890.1; 438/21

(58) Field of Classification Search ..... None
See application file for complete search history.

(56) References Cited

U.S. PATENT DOCUMENTS 4,914,562 A 4/1990 Abe et al.
5,308,442 A 5/1994 Taub et al.
5,387,314 A 2/1995 Baughman et al.
5,831,648 A 11/1998 Mitani et al.
6,155,674 A 12/2000 Figueredo et al.
6,214,245 B1 4/2001 Hawkins et al.
6,267,471 B1 7/2001 Ramaswami et al.
6,951,622 B2 * 10/2005 Chung et al. ..... 216/27
2002/0012027 A1 1/2002 Moon et al.
2005/0282089 A1 * 12/2005 Chung et al. ..... 430/320

FOREIGN PATENT DOCUMENTS

EP 0 317 171 A2 5/1989

* cited by examiner

*Primary Examiner*—Allan Olsen
(74) *Attorney, Agent, or Firm*—Akin Gump Strauss Hauer & Feld LLP

(57) ABSTRACT

A method for fabricating a thermal inkjet head equipped with symmetrical heaters and a rapid ink refill mechanism and the head fabricated by the method are provided. The method incorporates two thick photoresist deposition processes and a nickel electroplating process. The first thick photoresist deposition process is carried out to form a primary ink chamber and an auxiliary ink chamber in fluid communication with a funnel-shaped manifold and an injector orifice. The second thick photoresist deposition process forms a mold for forming an injector passageway that leads to the injector orifice. The nickel electroplating process provides an orifice plate on top of the inkjet head through which an injector passageway that leads to the injector orifice is provided for injecting ink droplets.

10 Claims, 4 Drawing Sheets

METHOD FOR FABRICATING A THERMAL BUBBLE INKJET PRINT HEAD WITH RAPID INK REFILL MECHANISM AND OFF-SHOOTER HEATER

CROSS-REFERENCE TO RELATED APPLICATIONS

This application is a division of U.S. patent application Ser. No. 10/057,026, filed Jan. 24, 2002 now U.S. Pat. No. 7,011,392, now allowed, the disclosure of which is incorporated herein by reference.

BACKGROUND OF THE INVENTION

The present invention generally relates to an integrated micro-droplet generator and more particularly, relates to a thermal bubble type inkjet head that is equipped with a rapid ink refill mechanism and off-shooter heater and a method for fabricating the head.

Since the advent of printers, and specifically for low cost printers for personal computers, a variety of inkjet printing mechanisms have been developed and utilized in the industry. These inkjet printing mechanisms include the piezoelectric type, the electrostatic type and the thermal bubble type, etc. After the first thermal inkjet printer becomes commercially available in the early 1980's, there has been a great progress in the development of inkjet printing technology.

In an inkjet printer, a liquid droplet injector is one of the key mechanisms. To provide a high-quality and reliable inkjet printer, the availability of a liquid droplet injector capable of supplying high-quality droplets at high-frequency and high-spacial resolution is critical.

Presently, there are two types of inkjet printers that are available in the marketplace, the piezoelectric type and the thermal type. The thermal inkjet system, also known as thermal bubble inkjet system, as thermally driven bubble system or as bubble jet system utilizes bubble to eject ink droplets out of an ink supply chamber, while piezoelectric printers utilize piezoelectric actuators to pump ink out from a reservoir chamber. The principle of operation for a thermal bubble inkjet system is that an electrical current is first conducted to the heater by an electrode to boil liquid in an ink reservoir chamber. When the liquid is in a boiling state, bubble forms in the liquid and expands and thus functions as a pump to eject a fixed quantity of liquid from the reservoir chamber through an orifice and then forms into droplets. When the electrical current is turned-off, the bubble generated collapses and liquid refills the chamber by capillary force.

When evaluating the performance of a thermal bubble inkjet system, factors such as droplet ejection frequency, cross-talk between adjacent chambers and the generation of satellite droplets are considered. Two of these performance factors, i.e. the satellite droplets, which degrade the sharpness of the image produced and the cross-talk between adjacent chambers and flow channels which decreases the quality and reliability of the inkjet system are frequently encountered. In order to improve the performance of a thermal bubble inkjet system, these drawbacks must be corrected.

BRIEF SUMMARY OF THE INVENTION

It is therefore an object of the present invention to a provide a micro droplet generator, particularly related to a thermal bubble inkjet head that does not have the drawbacks or the shortcomings of the conventional thermal bubble inkjet head.

It is another object of the present invention to provide a thermal bubble inkjet head that is equipped with symmetrical heaters of the off-shooter type for generating bubbles.

It is a further object of the present invention to provide a method for fabricating a thermal bubble inkjet head that utilizes rapid ink refill mechanism to generate ink droplets.

It is another further object of the present invention to provide a thermal bubble inkjet head that is equipped with a primary and an auxiliary ink chamber.

It is still another object of the present invention to provide a thermal bubble inkjet head that is equipped with two separate heaters as two sources for generating bubbles.

It is yet another object of the present invention to provide a method for fabricating a thermal bubble inkjet head that is equipped with symmetrical heaters and a rapid ink refill mechanism.

It is still another further object of the present invention to provide a method for fabricating a thermal bubble inkjet head that is equipped with symmetrical heaters and a rapid ink refill mechanism by utilizing two separate thick photoresist deposition processes and a nickel electroplating process.

In accordance with the present invention, a thermal bubble inkjet head that is equipped with symmetrical heaters and a rapid ink refill mechanism and a method for fabricating such head are disclosed.

In a preferred embodiment, a method for fabricating a thermal bubble inkjet head that is equipped with off-shooter heaters and a rapid ink refill mechanism is provided which includes the operating steps of providing a silicon substrate that has a top surface and a bottom surface; forming a first and a second insulating material layer of at least 1000 Å thick on the top and bottom surfaces; reactive ion etching an opening for a manifold in the two insulating material layers on the bottom surface; wet etching a funnel-shaped manifold in the silicon substrate; forming two spaced-apart heaters on the two insulating material layers on the top surface; depositing and patterning two interconnects with a conductive metal each in electrical communication with one of the two spaced-apart heaters; depositing a third insulating material layer which may consist of two materials on top of the two spaced-apart heaters and the first insulating material layer; spin-coating a first photoresist layer of at least 2 μm thick on top of the third insulating material layer; patterning by UV exposure a primary and an auxiliary ink chamber in fluid communication with each other in the first photoresist layer; depositing a metal seed layer on the first photoresist layer and patterning an inkjet orifice in the metal seed layer; spin-coating a second photoresist layer of at least 1 μm thick on the metal seed layer and patterning the inkjet orifice; removing the developed second photoresist layer except on top of the inkjet orifice; electroplating nickel on top of the metal seed layer encapsulating the second photoresist layer on top of the inkjet orifice; stripping away the second photoresist layer on top of the inkjet orifice; reactive ion etching from the backside away the first two insulating material layers on the top surface of the silicon substrate and the third insulating material layer exposed in the manifold; and stripping away the first photoresist layer from the primary and auxiliary ink chambers.

The method for fabricating a thermal bubble inkjet head may further include the step of forming the first and second insulating material layers by either $SiO_2$ or $Si_3N_4$, or the step of wet etching a funnel-shaped manifold in the silicon substrate by KOH, TMAH, or the step of forming the two spaced-apart heaters with TaAl, or the step of depositing the third insulating material layer with $Si_3N_4$ or SiC. The method may further include the step of spin-coating a first photoresist layer preferably of at least 2 μm thick, or the step of depositing the metal seed layer of Cr and Ni, or the step of stripping away the second photoresist layer by a wet etching method, or the step of stripping away the first photoresist layer from the primary and auxiliary ink chambers by a wet etching technique, or the step of patterning the inkjet orifice in the metal seed layer adjacent to a pair of the two spaced-apart heaters.

The present invention is further directed to a thermal bubble inkjet head this is equipped with symmetrical heaters and rapid ink refill mechanism which includes a silicon substrate that has a top surface and a bottom surface; a first and a second insulating material layer of at least 1000 Å thick on the top and bottom surfaces; a funnel-shaped manifold formed in the second insulating material layer and the silicon substrate; two spaced-apart heaters formed on the first insulating material layer on the top surface; two interconnects formed of a conductive metal each in electrical communication with one of the two spaced-apart heaters; a third insulating material layer on top of the two spaced-apart heaters and the first insulating material layer; a first photoresist layer of at least 2 μm thick on top of the third insulating material layer; a primary and an auxiliary ink chamber formed in the first photoresist layer in fluid communication with each other and with the funnel-shaped manifold; a metal seed layer on top of the first photoresist layer and an inkjet orifice formed in the metal seed layer; and a Ni layer on top of the metal seed layer with an aperture formed therein in fluid communication with the inkjet orifice.

In the thermal bubble inkjet head that is equipped with a ring-shaped symmetrical heater and a rapid ink refill mechanism, the first photoresist layer preferably has a thickness of at least 5000 Å, the inkjet orifice is formed in close proximity to the ring-shaped heater; the first and second insulating material layers may be a $SiO_2$ layer or a $Si_3N_4$ layer. The two spaced-apart heaters may be formed of TaAl, the metal seed layer may be deposited of Cr or Ni. One of the two spaced-apart heaters may be positioned in the auxiliary ink chamber. The ring-shaped symmetrical heater may be positioned in the primary ink chamber. The inkjet orifice may be formed in the primary ink chamber opposite to the ring-shaped symmetrical heater. The inkjet head may be a monolithic head.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

The present invention discloses a thermal bubble inkjet head that is equipped with a symmetrical ring-shaped heater and a rapid ink refill mechanism. The present invention further discloses a method for fabricating the thermal bubble inkjet head.

In the present invention method, two separate thick photoresist deposition processes by spin-coating and a nickel electroplating process are incorporated for achieving the final structure. The first thick photoresist spin-coating process is used for forming the ink chambers which include a primary chamber and an auxiliary chamber. The second thick photoresist spin-coating process is used to form a mold layer for forming an inkjet orifice. The nickel electroplating process is used to form a top plate on the inkjet head through which an injector orifice is formed. None of these novel processing steps is used in conventional inkjet head formation methods.

The present invention thermal bubble inkjet head has a construction of the monolithic type formed on a silicon single crystal substrate. A first ring-shaped heater electrode is formed in a symmetrical manner for superior liquid droplet generation. The first ring-shaped heater electrode is further formed with a high directional perpendicularity. With the present invention symmetrically constructed ring-shaped heater electrode, the problems of satellite droplets and interferences between adjacent orifices and flow channels can be minimized. Furthermore, after an ink droplet is produced by the bubbles generated by the first heater electrode in the primary ink chamber, the second heater electrode that is positioned upstream from the primary ink chamber is activated to generate a bubble such that a flow of ink is accelerated toward the primary ink chamber. This allows a rapid ink refill mechanism for the primary ink chamber and reduces the refill time otherwise required without the second heater electrode. Moreover, the rapid ink refill mechanism increases the generating frequency for the ink droplets, which in-turn increases the printing speed of the printer that utilizes the thermal bubble inkjet head of the present invention. The various benefits and advantages described above are achieved by the present invention symmetrical ring-shaped heater electrode which can be arranged either in a off-shooter arrangement or in a back-shooter arrangement. The term "off shooter" means the position of the heater off shifted the position of the nozzle from the normal direction. An off-shooter arrangement process flow is described below, while the process flow for a back-shooter arrangement can be similarly executed with minor modifications.

Figure 1A:
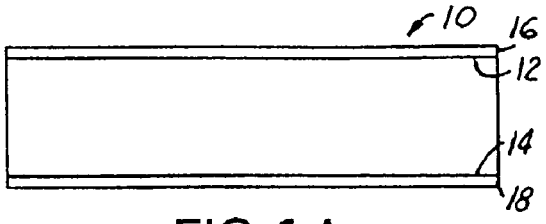
FIG. 1A is an enlarged, cross-sectional view of a present invention silicon substrate coated with an insulating material layer on a top surface and a bottom surface.

Referring initially to FIG. 1A, wherein a silicon substrate 10 used for constructing the present invention inkjet head is shown. On a top surface 12 of the silicon substrate, and on a bottom surface 14 of the same, is then deposited by a low pressure chemical vapor deposition method insulating material layers 16 and 18, respectively. The insulating material layers 16, 18 can be formed of either $SiO_2$ or $Si_3N_4$ to a thickness of about 1000 Å, and preferably to about 2000 Å. In the preferred embodiment, a P-type 100 mm diameter silicon wafer that has a crystal orientation of (100) is utilized. A RCA cleaning procedure is first used to clean the wafer prior to processing. The $SiO_2$ layer may also be formed by a wet oxidation method in a furnace tube to a thickness larger than 1 μm.

Figure 1B:
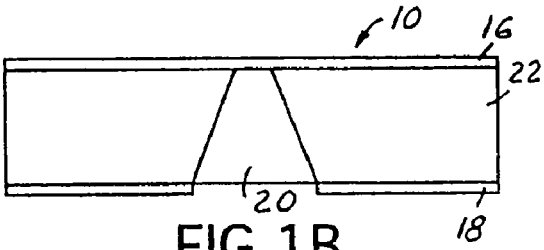
FIG. 1B is an enlarged, cross-sectional view of the present invention silicon substrate of FIG. 1A with an opening dry etched in the bottom insulating layer and a funnel-shaped manifold wet etched in the silicon substrate.

A first mask is then used, as shown in FIG. 1B, in a photolithographic process to define the position of manifold 20 and forming the manifold 20 by first dry etching the $SiO_2$ layer 18 by a reactive ion etching technique, and then etching the silicon layer 22 by a wet etching process utilizing a KOH or TMAH solution. The process is completed by rinsing the wafer with DI (deionized) water.

Figure 1C:
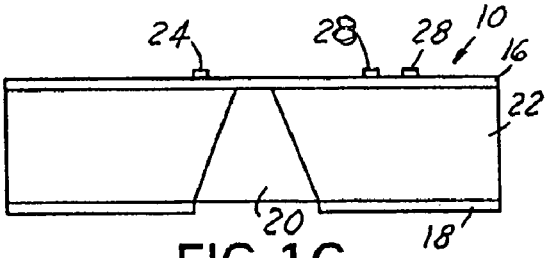
FIG. 1C is an enlarged, cross-sectional view of the present invention silicon substrate of FIG. 1B with a metal layer deposited on top and formed into two spaced-apart heaters.

In the next step of the process, shown in FIG. 1C, a second mask is first used in a photolithographic process to define the locations of the various heater electrodes 24 and 28. A metal/alloy layer such as TaAl alloy is then evaporated on top of the insulating material layer 16 and patterned into two heater electrodes 24 and 28. The process is again completed with a DI water rinsing of the silicon wafer.

Figure 1D:
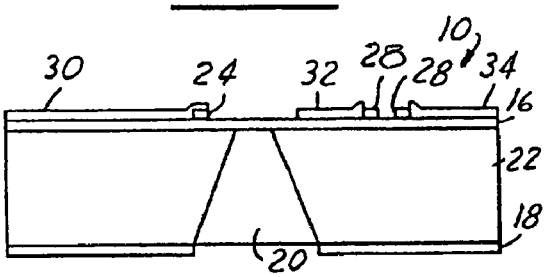
FIG. 1D is an enlarged, cross-sectional view of the present invention silicon substrate of FIG. 1C with two interconnections formed each connecting to one of the two spaced-apart heaters.
Figure 1E:
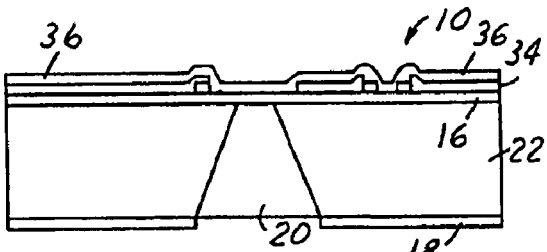
FIG. 1E is an enlarged, cross-sectional view of the present invention silicon substrate of FIG. 1D with a passivation layer deposited on top of the substrate.

Various interconnection layers 30 and 34 are then formed on top of each of the heater electrodes 24 and 28, respectively, by first depositing a metal layer and then photolithographically patterning the metal layer. A third photomask is used for the interconnection forming process shown in FIG. 1D. Following the interconnection forming process, shown in FIG. 1E, an insulating material layer, or a passivation layer 36, is deposited on top of the silicon substrate 10 to provide insulation to the various structures of the interconnection 30 and 34 and the heater electrodes 24 and 28. The passivation layer 36 is a protection layer which can be deposited of a material selected from $Si_3N_4$, SiC and $SiO_2$ by a plasma enhanced chemical vapor deposition technique. This is shown in FIG. 1E.

Figure 1F:
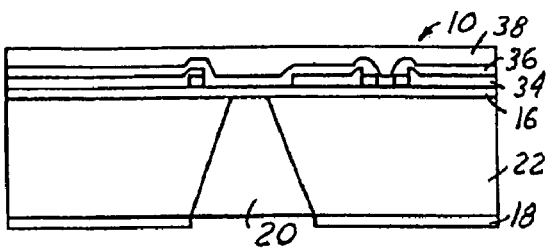
FIG. 1F is an enlarged, cross-sectional view of the present invention silicon substrate of FIG. 1E with a thick photoresist layer deposited on top.
Figure 1G:
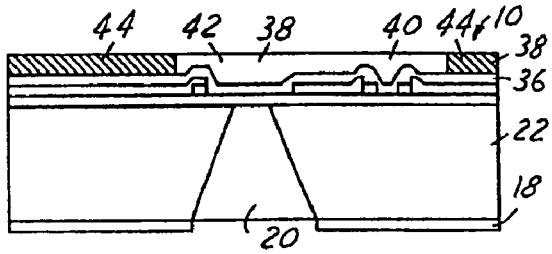
FIG. 1G is an enlarged, cross-sectional view of the present invention silicon substrate of FIG. 1F with a pattern formed in the photoresist layer by UV exposure.

The present invention novel method continues by the advantageous deposition step, shown in FIG. 1F, of a first thick photoresist layer 38 on top of the silicon substrate 10. The photoresist layer 38 should have a thickness of at least 20 μm, and preferably 25-35 μm deposited by a spin-coating technique and then baked for drying. An exposure process utilizing UV radiation, shown in FIG. 1G, follows by using a fourth photomask to define the size and location of the various ink chambers, i.e. the primary ink chamber 40 and the auxiliary chamber 42. A developing step is not executed at this stage such that all the photoresist layers 38, either the exposed portion 44 or the unexposed portion 48, stay on top of the silicon substrate 10. This is a critical step of the present invention and must be patterned with great accuracy such that the positions of the primary ink chamber 40 and the auxiliary ink chamber 42 can be determined.

Figure 1H:
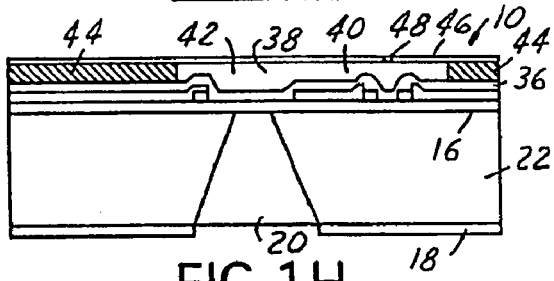
FIG. 1H is an enlarged, cross-sectional view of the present invention silicon substrate of FIG. 1G with a metal seed layer deposited and patterned on top for the inkjet orifice.

In the next step of the process, shown in FIG. 1H, a metal seed layer 46 is deposited on top of the photoresist layer 38, 44 and patterned to define an injection orifice 48 in the metal seed layer. The metal seed layer may be deposited of a Cr/Ni alloy by sputtering or evaporation and used as a seed layer for a subsequent electroplating process. A fifth photomask is used in a photolithography process to define the size and location of the injection orifice 48. The injection orifice 48 is formed by a wet etching technique followed by a process for removing the photoresist layer used in the lithography process.

Figure 1I:
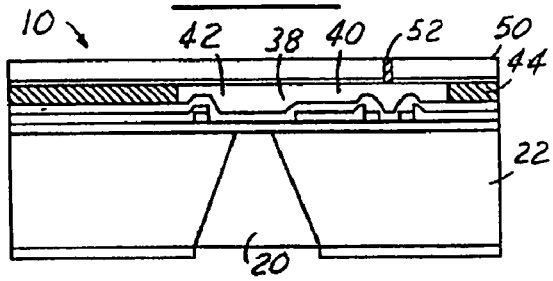
FIG. 1I is an enlarged, cross-sectional view of the present invention silicon substrate of FIG. 1H with a second thick photoresist layer spin-coated on top and patterned.
Figure 1J:
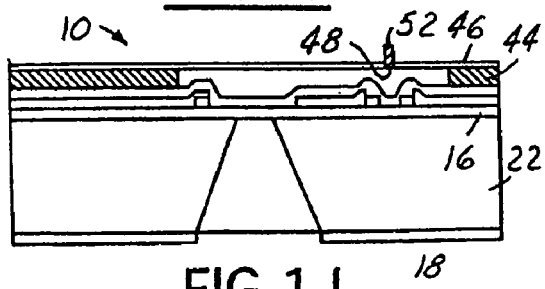
FIG. 1J is an enlarged, cross-sectional view of the present invention silicon substrate of FIG. 1I with the second photoresist layer developed.

The present invention novel method is followed, as shown in FIG. 1I, by a second thick photoresist layer 50 deposition process. The deposition can be carried out by a spin-coating technique and the photoresist layer 50 is patterned for the injection passage 52. The process is then followed by a photoresist developing process, during which the photoresist layer 50 is removed except at the injection passage 52, which stays on top of the injection orifice 48. This is shown in FIG. 1J.

Figure 1K:
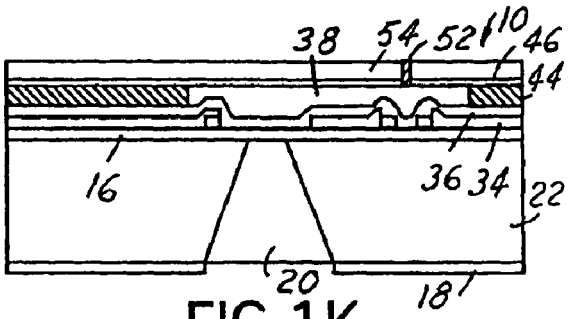
FIG. 1K is an enlarged, cross-sectional view of the present invention silicon substrate of FIG. 1J with an orifice plate electroplated on top.

An orifice plate 54 is then formed by a nickel electroplating process, as shown in FIG. 1K. The residual, second thick photoresist layer 50 in the injection passage 52 is then removed to form the injection passage in fluid communication with the primary ink chamber 40, as shown in FIG. 1L. The photoresist removal process is performed by a wet etching technique.

Figure 1M:
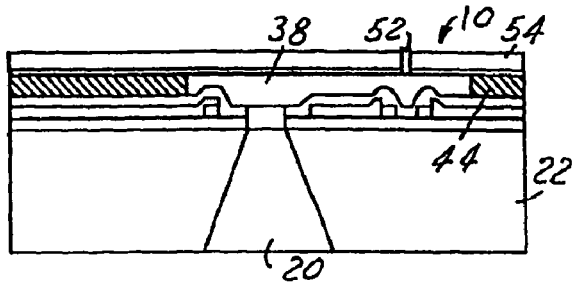
FIG. 1M is an enlarged, cross-sectional view of the present invention silicon substrate of FIG. 1L with the bottom insulating layer, the top insulating layer and the passivation layer stripped by dry etching.
Figure 1L:
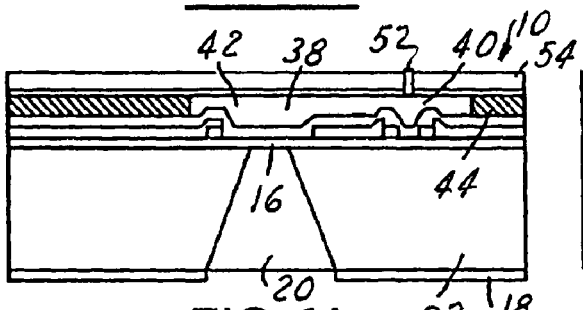
FIG. 1L is an enlarged, cross-sectional view of the present invention silicon substrate of FIG. 1K with the remaining second photoresist layer stripped to form the orifice.

The backside of the silicon substrate 10 is then etched by a reactive ion etching technique to remove the bottom insulating material layer 18, as shown in FIG. 1M, and the top insulating material layer 16 exposed in the manifold 20.

Figure 1N:
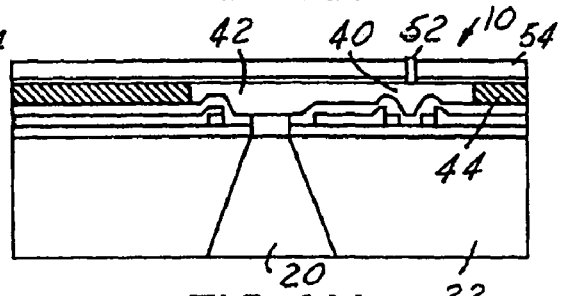
FIG. 1N is an enlarged, cross-sectional view of the present invention silicon substrate of FIG. 1M with the first photoresist layer stripped to form the primary and the auxiliary ink chambers.

In the final step of the process, as shown in FIG. 1N, the first thick photoresist layer 38 is removed by a developing solution to vacate the primary ink chamber 40 and the auxiliary ink chamber 42 in fluid communication with the manifold 20 and the injection passage 52. The present invention novel thermal bubble inkjet head that is equipped with a symmetrical ring-shaped heater and a rapid ink refill mechanism is thus completed.

Figure 2:
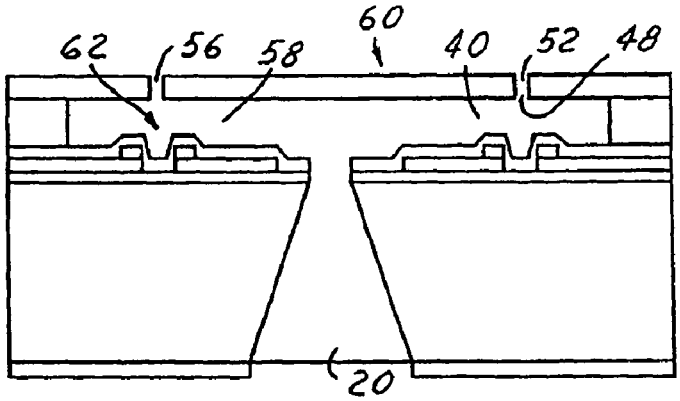
FIG. 2 is a enlarged, cross-sectional view of a second embodiment of the present invention thermal bubble inkjet head equipped with two inkjet orifices for two symmetrical off-shooter heaters.

In a second preferred embodiment of the present invention, as shown in FIG. 2, a thermal bubble inkjet head 60 is provided which includes, in addition to the first injection passage 52 and the first injection orifice 48, a second injection passage 56 which is formed in a symmetrical manner to the first injection passage 52. Instead of the first preferred embodiment, the second preferred embodiment is provided with two primary ink chambers 40 and 58. The processing steps for forming the present invention second embodiment is similar to that shown for forming the first embodiment except that a second ring-shaped heater electrode 62 and a second injection passage 56 are formed.

Figure 3A:
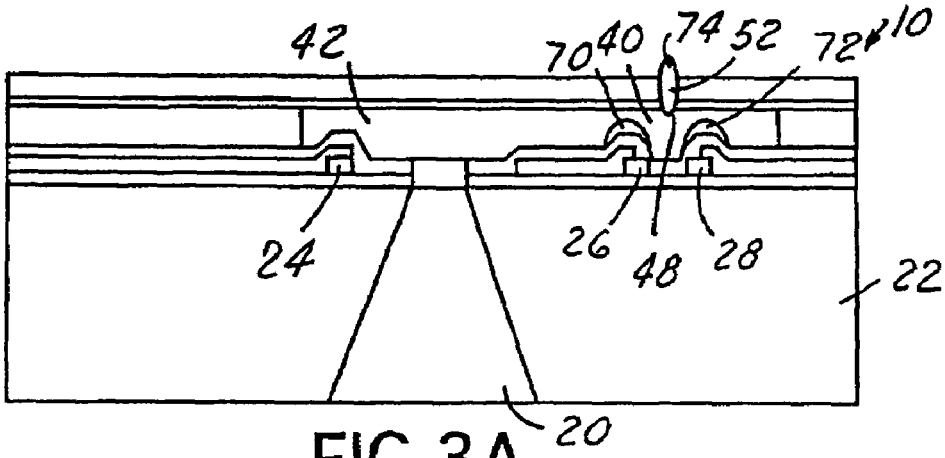
FIG. 3A is an enlarged, cross-sectional view of the present invention inkjet head illustrating its first operating step wherein a ring-shaped bubble is generated by the ring-shaped heater.
Figure 3B:
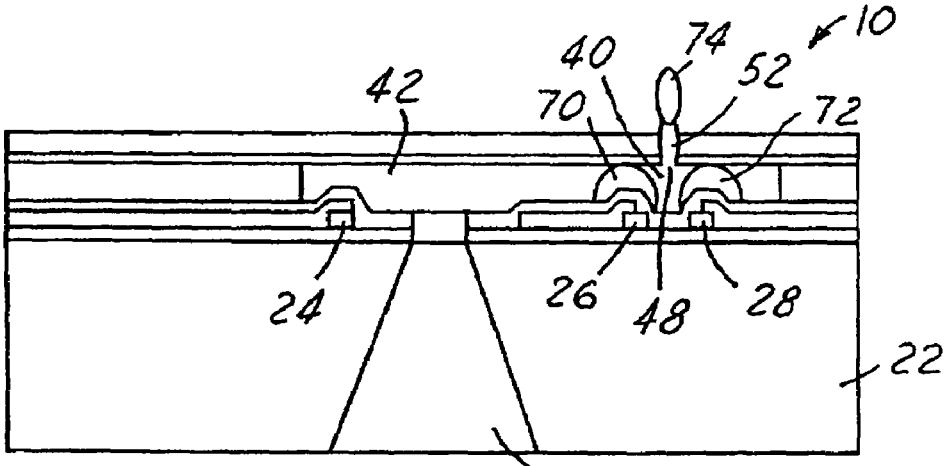
FIG. 3B is an enlarged, cross-sectional view of the present invention inkjet head illustrating the second operating step wherein the ring-shaped bubble is enlarged to push out an ink column.

The operation of the present invention thermal bubble inkjet head having an off-shooter arrangement is shown in FIGS. 3A-3F. At the beginning of the process, the funnel-shaped manifold 20, the primary ink chamber 40 and the auxiliary ink chamber 42 are filled with ink. The ring-shaped heater electrode 28 is then heated to produce a ring-shaped bubble 70. As a result, a small ink column 74 is pushed out of the ink passageway 52 through the orifice 48. At this stage, the auxiliary heater electrode 24, situated in the auxiliary chamber 42, is not heated. The ring-shaped bubble 70 enlarges, as shown in FIG. 3B, to further push the ink column 74 out of the inkjet passage 52, as the ring-shaped heater electrode 28 continuously heat the primary ink chamber 48.

Figure 3C:
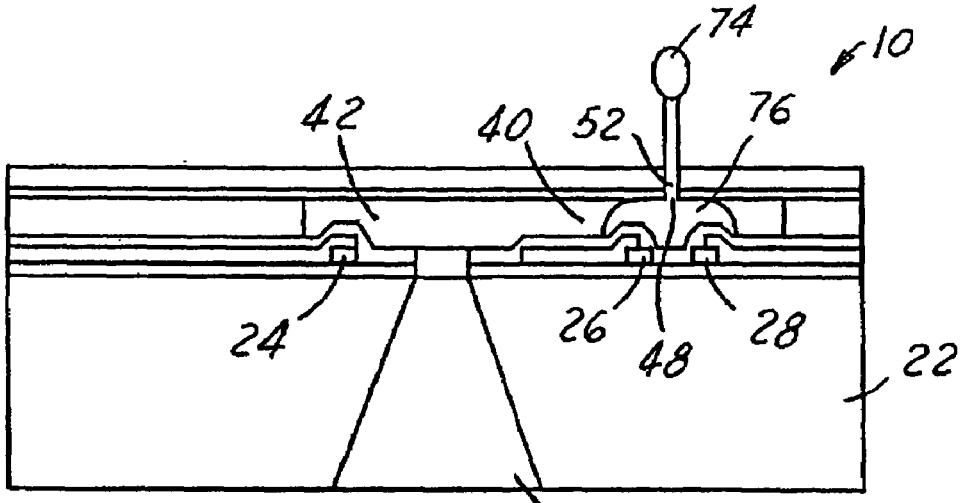
FIG. 3C is an enlarged, cross-sectional view of the present invention inkjet head illustrating the third operating step wherein the ring-shaped bubble generated emerges into a circular bubble.

Finally, as shown in FIG. 3C, the ring-shaped bubble 70 join forms a circular bubble 76 and thus, cutting off the ink droplet 74 completely from the ink contained in the primary ink chamber 40. As a result, the inkjet droplet 74 separates from the inkjet passageway 52 and projects toward the target.

Figure 3D:
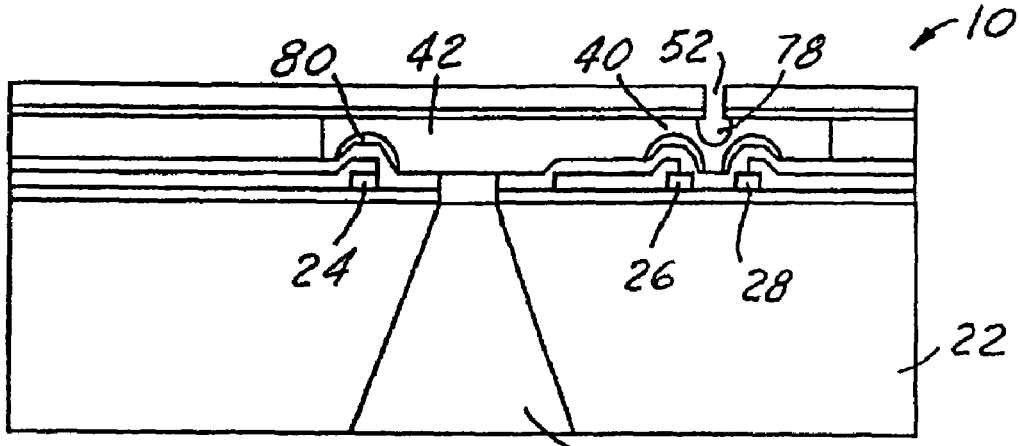
FIG. 3D is an enlarged, cross-sectional view of the present invention inkjet head illustrating the fourth operating step in which the bubble generated collapses.
Figure 3E:
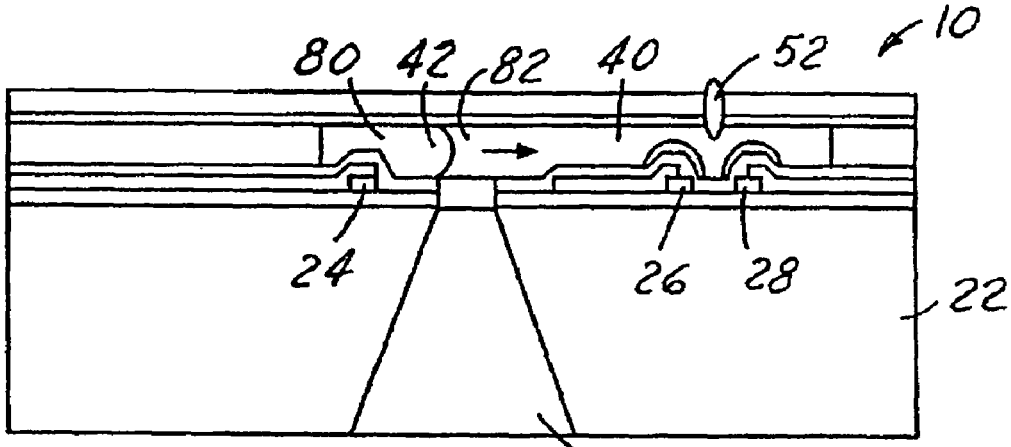
FIG. 3E is an enlarged, cross-sectional view of the present invention inkjet head illustrating the fifth operating step in which a bubble is generated by the auxiliary heater.

After the inkjet droplet 74 departs from the inkjet head 10, the bubble 76 collapses and moves downwardly forming a void 78, shown in FIG. 3D. Simultaneously, the heater electrode 24, situated in the auxiliary chamber 42, is activated, i.e. by sending an electrical current therethrough to generate heat. A bubble 80 is thus produced. As bubble 80 enlarges while continuously heated by the heater electrode 24, it expands from the auxiliary chamber 42 toward the primary ink chamber 40 and thus, pushing ink supply 82 in a refill action into and thus resupply the primary chamber 40. The off-shooter mechanism, or off-center shooter mechanism, is thus named for the present invention inkjet droplet formation process. This is shown in FIGS. 3A-3D.

Figure 3F:
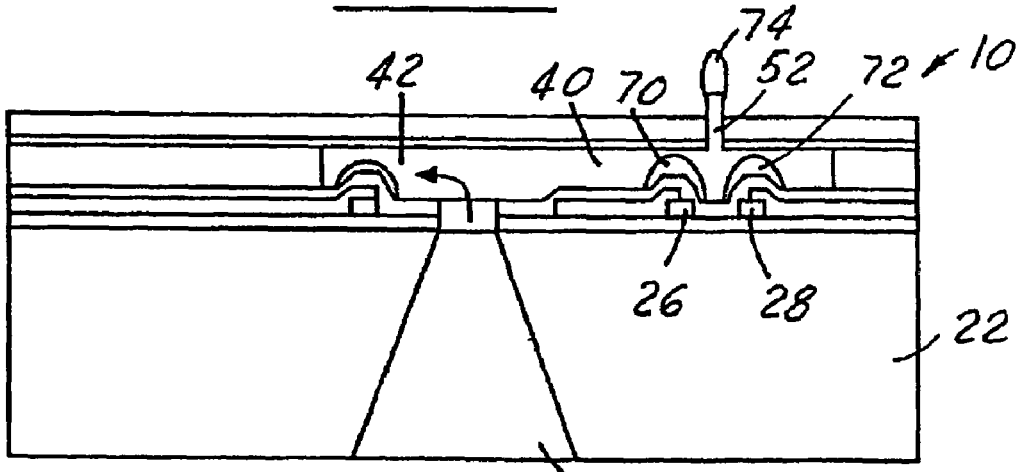
FIG. 3F is an enlarged, cross-sectional view of the present invention inkjet head illustrating the sixth operating step in which a ring-shaped bubble is generated by the ring-shaped heater to restart the liquid droplet formation process.

After ink 82 is re-supplied to the primary ink chamber 40, as shown in FIG. 3F, the process restarts in another cycle to produce another bubble 70 from the ring-shaped heater electrode 28. A new inkjet droplet 74 is thus reproduced.

The present invention novel thermal bubble inkjet head equipped with symmetrical heaters and a rapid ink refill mechanism and a method for fabricating the head have therefore been amply described in the above description and in the appended drawings of FIGS. 1A-3F.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for fabricating a thermal bubble inkjet head equipped with heaters and a rapid ink refill mechanism comprising the steps of:

providing a silicon substrate having a top surface and a bottom surface;

forming a first insulating material layer of at least 1000 Å thick on said top surface;

forming a second insulating material layer of at least 1000 Å thick on said bottom surface;

reactive ion etching an opening for a manifold in said second insulating material layer on said bottom surface;

wet etching a funnel-shaped manifold in said silicon substrate;

forming two spaced-apart heaters on said first insulating material layer on said top surface;

depositing and patterning two interconnects with a conductive metal each in electrical communication with one of said two spaced-apart heaters;

depositing a third insulating material layer on top of said two spaced-apart heaters and said first insulating material layer;

spin-coating a first photoresist layer of at least 2000 Å thick on top of said third insulating material layer;

patterning by UV exposure a primary and an auxiliary ink chamber in fluid communication with each other in said first photoresist layer;

depositing a metal seed layer on said first photoresist layer and patterning an inkjet orifice in said metal seed layer;

spin-coating a second photoresist layer of at least 2000 Å thick on said metal seed layer and patterning said inkjet orifice;

removing said developed second photoresist layer except on top of said inkjet orifice;

electroplating Ni on top of said metal seed layer encapsulating said second photoresist layer on top of said inkjet orifice;

stripping away said second photoresist layer on top of said inkjet orifice;

reactive ion etching away said second insulating material layer on said bottom surface of the silicon substrate and said first insulating material layer exposed in said manifold;

and stripping away said first photoresist layer from said primary and auxiliary ink chambers.

2. A method for fabricating a thermal bubble inkjet head equipped with heaters and a rapid ink refill mechanism according to claim 1 further comprising the step of forming said first and second insulating material layers by either $SiO_2$ or $Si_3N_4$.

3. A method for fabricating a thermal bubble inkjet head equipped with heaters and a rapid ink refill mechanism according to claim 1 further comprising the step of wet etching a funnel-shaped manifold in said silicon substrate by KOH.

4. A method for fabricating a thermal bubble inkjet head equipped with heaters and a rapid ink refill mechanism according to claim 1 further comprising the step of forming said two spaced-apart heaters with TaAl.

5. A method for fabricating a thermal bubble inkjet head equipped with heaters and a rapid ink refill mechanism according to claim 1 further comprising the step of depositing said third insulating material layer with $Si_3N_4$ or SiC.

6. A method for fabricating a thermal bubble inkjet head equipped with heaters and a rapid ink refill mechanism according to claim 1 further comprising the step of spin-coating a first photoresist layer preferably to at least 5000 Å thick.

7. A method for fabricating a thermal bubble inkjet head equipped with heaters and a rapid ink refill mechanism according to claim 1 further comprising the step of depositing said metal seed layer with Cr and Ni.

8. A method for fabricating a thermal bubble inkjet head equipped with heaters and a rapid ink refill mechanism according to claim 1 further comprising the step of stripping away said second photoresist layer by a wet etching method.

9. A method for fabricating a thermal bubble inkjet head equipped with heaters and a rapid ink refill mechanism according to claim 1 further comprising the step of stripping away said first photoresist layer from said primary and auxiliary ink chambers by a wet etching technique.

10. A method for fabricating a thermal bubble inkjet head equipped with heaters and a rapid ink refill mechanism according to claim 1 further comprising the step of patterning said inkjet orifice in said metal seed layer adjacent to a ring-shaped heater electrode.

* * * * *